US005366093A

United States Patent [19]

Huber

[11] Patent Number: 5,366,093

[45] Date of Patent: Nov. 22, 1994

[54] APPARATUS FOR SEPARATING PARTICULATE MATERIALS

[75] Inventor: Ronald W. Huber, Richmond, Va.

[73] Assignee: Reynolds Metals Company, Richmond, Va.

[21] Appl. No.: 120,114

[22] Filed: Sep. 10, 1993

[51] Int. Cl.[5] ..... B07B 4/00

[52] U.S. Cl. ..... 209/135; 209/137

[58] Field of Search ..... 209/134, 135, 136, 137, 209/156, 157

[56] References Cited

U.S. PATENT DOCUMENTS

| | | | |
|---|---|---|---|
| 197,897 | 12/1877 | Rice, II | 209/135 |
| 558,680 | 4/1886 | Faulkner . | |
| 669,182 | 3/1901 | Reynolds | 209/135 |
| 676,969 | 6/1901 | Stebbins . | |
| 1,054,183 | 2/1913 | Davis | 209/135 |
| 1,530,277 | 3/1925 | Mettler, Sr. | 209/137 |
| 1,742,812 | 1/1930 | Huneycutt | 209/135 |
| 1,834,981 | 12/1931 | Stebbins . | |
| 1,949,279 | 2/1934 | Kreisinger . | |
| 2,656,572 | 10/1953 | Smallwood . | |
| 2,978,103 | 4/1961 | Cowher, Sr. . | |
| 3,047,147 | 7/1962 | De Koning . | |
| 3,055,597 | 9/1962 | Mund . | |
| 3,113,099 | 12/1963 | Schmitz . | |
| 3,278,026 | 10/1966 | Bishard . | |
| 3,409,025 | 11/1968 | Wochnowski . | |
| 3,426,893 | 2/1969 | Stark . | |
| 3,642,131 | 2/1972 | Bartles et al. . | |
| 3,799,339 | 3/1974 | Breitholtz et al. . | |
| 3,856,217 | 12/1974 | Brewer . . | |
| 3,907,670 | 9/1975 | Fernandes | 209/137 |
| 3,956,106 | 5/1976 | Muck et al. . | |
| 4,165,278 | 8/1979 | Jaffey . | |
| 4,191,294 | 3/1980 | McGrath, Jr. et al. . | |
| 4,222,858 | 9/1980 | Avila et al. . | |
| 4,242,197 | 12/1980 | Voelskow et al. . | |
| 4,253,940 | 3/1981 | Price . | |
| 4,418,871 | 12/1983 | Powell . | |
| 4,853,112 | 8/1989 | Brown . | |
| 4,908,123 | 3/1990 | Miers . | |
| 4,921,173 | 5/1990 | Bartley . | |
| 4,930,707 | 6/1990 | Oshiro et al. . | |
| 4,941,619 | 7/1990 | Cutler . | |
| 4,988,044 | 1/1991 | Weitzman et al. . | |
| 5,009,370 | 4/1991 | Mackenzie . | |
| 5,060,871 | 10/1991 | Brassinga et al. . | |
| 5,106,487 | 4/1992 | Nemedi . | |
| 5,133,505 | 7/1992 | Bourcier et al. . | |
| 5,169,073 | 12/1992 | Marabini et al. . | |
| 5,174,509 | 12/1992 | Starke et al. . | |
| 5,184,780 | 2/1993 | Wiens . | |

FOREIGN PATENT DOCUMENTS

| | | | |
|---|---|---|---|
| 508593 | 1/1955 | Italy | 209/135 |
| 0040867 | 3/1977 | Japan | 209/135 |
| 574908 | 1/1946 | United Kingdom | 209/135 |

OTHER PUBLICATIONS

LoVac Technology-Design and Application, Aug. 1989.

LoVac Technology-Separation of Shredded MSW, Aug. 1989.

*Primary Examiner*—D. Glenn Dayoan

*Attorney, Agent, or Firm*—Alan M. Biddison

[57] ABSTRACT

Apparatus for separating heavier, undesired components from recycle material that includes used aluminum beverage cans. The apparatus includes a particle separation conduit that is positioned between a shredder, for reducing the recycle material to particulate form, and a suction blower, for conveying the shredded material from the shredder into the particle separation conduit and for conveying the separated shredded aluminum alloy to a receptacle after separation of the heavier components, which can include lead, brass and glass. Adjacent the conduit inlet is a diverging first section that has a gradually enlarging cross-sectional area, and adjacent the conduit outlet is a significantly shorter length, second section that has a decreasing cross-sectional area. The first and second sections are joined in a region close to the conduit outlet. A second outlet opening is provided in the lowermost portion of the conduit at the junction of the first and second sections to permit the withdrawal of heavier, undesired particles from a flowing air stream containing shredded recycle material.

20 Claims, 2 Drawing Sheets

APPARATUS FOR SEPARATING PARTICULATE MATERIALS

BACKGROUND OF THE INVENTION

1. Field of the Invention

The present invention relates to apparatus for separating undesired metallic and other heavy particulates from a mixture of particulate materials containing aluminum alloy particles. More particularly, the present invention relates to apparatus for separating particles of lead, brass, copper, and other relatively heavy materials from a particulate stream that includes shredded used aluminum alloy beverage containers.

2. Description of the Related Art

The recycling of aluminum alloy used beverage containers (UBC) has been encouraged for some time as a way of reusing previously processed aluminum and thereby helping to conserve a substantial quantity of the energy that would otherwise be needed to obtain usable aluminum from bauxite. Recycling of UBC also helps to preserve the environment by encouraging the collection of UBC and thereby removing them from streets, roadways, and other public places.

In order to encourage the collection of UBC for recycling, the promoters of recycling efforts, of which the aluminum producers themselves are in the forefront, frequently provide financial incentives in the form of cash payments to those who collect and return UBC to a recycling center. The payments made to those who present recyclable UBC-containing material are based upon the weight of such material that is presented for recycling. However, in addition to including UBC, the material offered for recycling very often contains other, undesirable, ferrous and non-ferrous metals and other relatively heavy materials that are not desired in aluminum to be remelted.

Among the undesirable materials present in materials presented for recycling is lead. Although lead is sometimes present in very small amounts in aluminum in alloyed form, oftentimes, however, free lead has been either inadvertently or intentionally included in the UBC offered for recycling. Free lead can be present in many different forms, such as tire weights, fishing weights, lead foils, lead shot, batteries, solder, padlocks, and lead-containing dust. Other undesirable materials sometimes present in materials presented for recycling include ferrous articles, brass, copper, glass, and other heavy contaminants.

Such undesirable materials should be separated from the collected recycle material, at least partially, in order to minimize contaminants so as to reduce the required additions of virgin metal.

One approach to the separation of heavy constituents from light constituents in a comminuted mixture is disclosed in U.S. Pat. No. 4,853,112, which issued on Aug. 1, 1989, to Victor Brown. That patent shows an air classification apparatus for separating heavy from lighter components of comminuted municipal waste. However, the apparatus as disclosed involves a complicated air classifier that includes an air bypass arrangement that includes at least two flow control dampers that must be properly positioned for the system to operate effectively.

It is therefore an object of the present invention to provide a relatively simple, effective, and efficient apparatus for removing heavy, undesirable components from UBC.

SUMMARY OF THE INVENTION

Briefly stated, in accordance with one aspect of the present invention, apparatus is provided for separating from an air stream containing particles having different weights the heavier weight particles as the stream passes through a flow conduit. A particle separation conduit is provided for receiving and conveying a stream of particles and for separating the heavier weight particles contained within the stream from the lighter weight particles contained within the stream.

The separation conduit includes an inlet for receiving a stream of particles, an outlet spaced from the inlet for conveying particles away from the conduit, and an intermediate section positioned between the inlet and the outlet. The intermediate section includes a first, diverging portion, a second converging portion, and a particle outlet in a lower region of the section. The diverging portion has a proximal end adjacent the conduit inlet and a distal end intermediate the conduit's inlet and outlet. The cross sectional area of the first portion increases, preferably gradually, in a direction from its proximal end to its distal end. The converging portion has a proximal end in the vicinity of, or, preferably, merging with, the distal end of the first portion. The distal end of the second portion is adjacent the conduit outlet. The cross sectional area of the second portion decreases, preferably gradually, in a direction from its proximal end to its distal end. The particle outlet is located at a lower portion of the intermediate section, preferably in the region where the first and second portions merge. The particle outlet permits removal from the intermediate section of heavier weight particles that settle out from a stream of particles moving through the intermediate section. The length of the second, converging portion of the intermediate section is shorter than that of the first, diverging portion.

In accordance with another aspect of the present invention, a recycling plant is provided for receiving material for recycling, wherein the material includes used aluminum alloy beverage cans to be recovered for reprocessing. The plant includes a shredder for reducing the size of the material presented for recycling, a blower for conveying particles of shredded recyclable material from the shredder to a container for transport to a melting station, and a separation conduit positioned between the shredder and the blower for separating heavier weight particles from lighter weight particles as shredded particles pass through the separation conduit from the shredder to the blower. The separation conduit has the structure of the separation conduit forming part of the first aspect of the invention.

DESCRIPTION OF THE PREFERRED EMBODIMENTS

Figure 1:
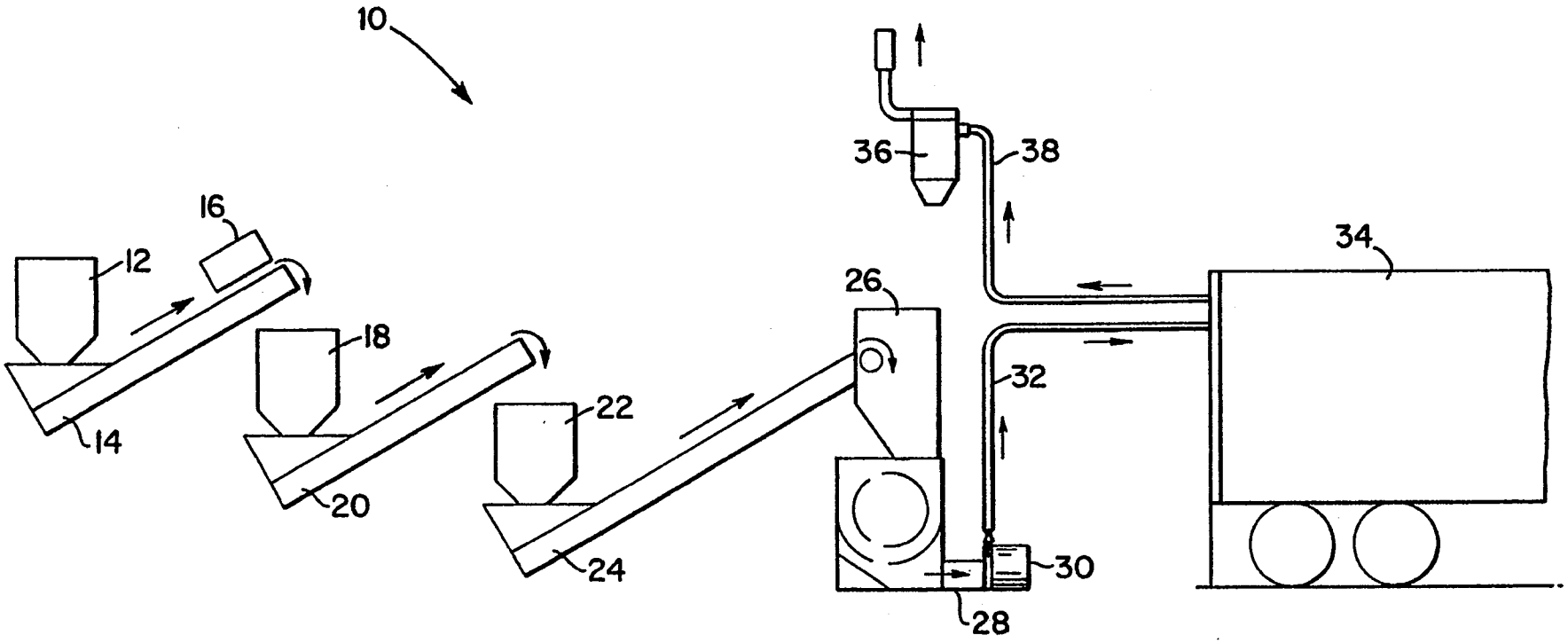
FIG. 1 is a schematic view of a recycling plant including a shredder and several types of separator devices for separating contaminants and undesirable materials from material being recycled.

Referring now to the drawings, and particularly to FIG. 1 thereof, there is shown in schematic form the several elements of a shredding plant 10 for shredding materials presented for recycling, and for separating undesirable contaminants from shredded aluminum alloy UBC materials. The materials to be processed generally include crushed and uncrushed aluminum alloy UBC, together with various types and forms of non-aluminum-alloy materials, either intermixed with the UBC or included inside the UBC.

Plant 10 includes a receiving hopper 12 into which the raw recyclable material is deposited, from which the material falls onto an upwardly moving, inclined first conveyor belt 14 to provide a substantially uniform layer of recyclable material. Belt 14 carries the recyclable material past a magnetic separator 16 that provides a magnetic field to remove from the recyclable material undesired magnetically permeable, ferrous-based materials.

After separation of the magnetically permeable materials, the resulting, substantially ferrous-free material stream falls from conveyor 14 into tank scale 18 for weighing. After weighing the material is deposited onto upwardly moving, inclined conveyor 20 from which it falls into a surge hopper 22 to provide a substantially continuous, constant rate of material flow onto upwardly moving, inclined feed conveyor 24, which conveys the material into shredder 26 for particle size reduction to a desired maximum particle size, for instance of from about ¾ inch to about 1½ inch.

The receiving hopper 12, conveyor belt 14, magnetic separator 16, tank scale 18, conveyor 20, surge hopper 22, feed conveyor 24, and shredder 26 are all known to those skilled in the art and need not be described in detail. For example, in one embodiment, shredder 26 can be a Model WC-18 or Model WC-30 shredder manufactured by American Pulverizer Company, of St. Louis, Mo., or other comparable equipment.

The output from shredder 26 has a density on the order of from about 10 lb./ft.$^3$ to about 20 lb./ft.$^3$, and is conveyed from shredder 26 through a conduit 28 by a blower 30 into a feed conduit 32 that conveys the shredded material to storage, such as a shred trailer 34. The shredded material may be transported to a reclamation plant for remelting and subsequent processing into new aluminum alloy cans and other aluminum alloy articles. A cyclone separator 36 can be connected with trailer 34 by a conduit 38 to withdraw powdered and other lightweight materials, such as paper shreds, and to separate those items from the collected shreds within trailer 34. The use of a blower to convey materials from a shredder to a trailer and the use of a cyclone separator to remove lightweight materials from the trailer is known to those skilled in the art.

In one embodiment of the present invention, conduit 28, which extends between the outlet of shredder 26 and the inlet of blower 30, is a tubular structure. As shown in greater detail in FIGS. 2 and 3, conduit 28 has a rectilinear linear central axis 40 that lies in a substantially horizontal plane that extends from the center of a circular inlet opening 42 to the center of a circular outlet opening 44, which preferably is of the same size as that of the inlet opening. As shown, a flow straightening rectilinear inlet section 41 can be provided at inlet 42 of conduit 28 to connect the conduit to the outlet of shredder 26. A flow straightening rectilinear outlet section 43 can be provided at outlet 44 to connect conduit 28 to the housing of blower 30. Flow straightening sections 41 and 43 help to provide substantially axial flow of shredded UBC through conduit 28.

Upper portion 46 of conduit 28, that portion lying above a horizontal plane 50 passing through central axis 40, is preferably semicircular in cross section, having its center of curvature coincident with axis 40, and is symmetrical about a vertical plane 52 passing through axis 40. Lower portion 48 of conduit 28, that portion lying below horizontal plane 50, is of non-constant cross-sectional area, to define a bulbous flow passageway within conduit 28 that first increases and then decreases in cross-sectional area in a direction from inlet 42 toward outlet 44. Preferably, the changes in cross-sectional area are gradual.

The diverging portion 51 of the conduit has a proximal end **48*a* in the vicinity of inlet 42 and a distal end 48*b* in the vicinity of transverse plane 54. The converging portion 53 of conduit 28 has a proximal end 48*c* confronting end 48*b* and a distal end 48*d* in the vicinity of outlet 44**.

Figure 3:
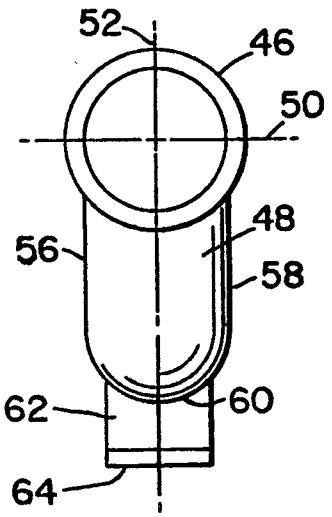
FIG. 3 is an end view of the separator device shown in FIG. 2.

From plane 54 toward outlet 44 the cross-sectional area within conduit 28 gradually decreases. Lower portion 48 is also symmetrical about vertical plane 52, and as best seen in FIG. 3, lower portion 48 includes spaced, opposed, substantially vertically extending sidewalls 56, 58 that interconnect with rounded bottom wall 60. At transverse plane 54 lower portion 48 includes a relatively short, downwardly extending conduit 62 terminating in a discharge opening 64 that is open to the ambient environment during operation so that air can be drawn into conduit 28.

Referring once again to FIG. 2, the lowermost part of bottom wall 60 in the diverging section of lower portion 48 defines an angle $\theta_1$ with the horizontal, and the corresponding part in the converging section of lower portion 48 defines an angle $\theta_2$ with the horizontal. Preferably, $\theta_2$ is within about 30° to about 60°, while $\theta_1$ can vary from about 6° to about 20°, depending upon the overall length of conduit 28. For example, in a system incorporating an American Pulverizer Company Model WC-18 shredder, for which the shredding rate can be between about 4,500 lb./hr. to about 10,000 lb./hr., the precise rate being dependent upon the density of the input UBC and the condition of the shredder and related equipment, a preferred form for conduit 28 has an overall length of 4 feet, an upper portion radius of 4 inches, an inclination angle $\theta_2$ of 60°, an inclination angle $\theta_1$ of 13.4°, and an outlet conduit defined by a 4 inch square.

Figure 2:
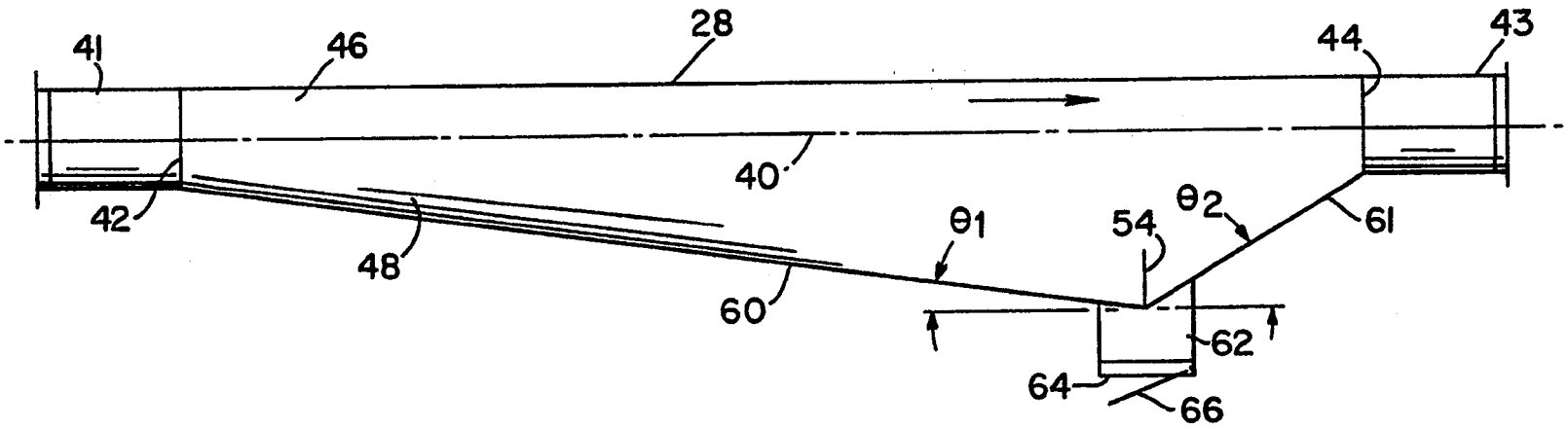
FIG. 2 is a schematic side elevational view of one embodiment of a separator device according to the present invention for separating heavier materials from shredded aluminum alloy UBC.

Operating experience with a system of the type herein disclosed that includes a conduit having the configuration of conduit 28 as shown in FIGS. 2 and 3 has revealed that improved performance is obtained, and a higher percentage of the undesirable heavier particles is removed, when $\theta_2$ is about 60°, which places axis 54 of outlet conduit 62 about 6 inches from conduit outlet 44. Additionally, although the overall length of conduit 28 can range from about 8 feet to about 4 feet, slightly better separation performance was observed with the 4 foot length embodiment.

Similarly, although the position along axis 40 of outlet conduit axis 54 can vary, and tests have been run with a 4 foot long conduit at spacings of axis 54 from outlet 44 ranging from about 6 inches to about 18 inches, better separation performance was observed at the shorter, 6 inch spacing. In any event, the structure of conduit 28 is such that the axis 54 of outlet conduit 62 is positioned significantly closer to outlet 44 than to inlet 42. Such an arrangement provides a steeper slope to wall 61 than that of wall 60, and serves to minimize the possibility that heavier contaminant particles, those that have fallen downwardly toward wall 60 of conduit 28 as the stream of shredded particles moves through conduit 28 from inlet 42 to outlet 44, will tend to climb up along wall 61 by virtue of the horizontal component of their momentum. Preferably, the axial length along conduit axis 40 of the converging portion of lower portion 48 is less than about 38% of the total axial length of lower portion 48, and most preferably it ranges from about 5% to about 20% of the total length of lower portion 48. Additionally, the cross-sectional area of outlet conduit 62 is preferably about ⅓ that of the cross-sectional area of outlet 44.

The separation of the undesirable, heavier, contaminant particles has been found to be of the order of about 65% to about 75% efficient when conduit 28 is configured as disclosed above. That configuration results in a reduction of the horizontal component of the initial particle velocity at inlet 42 of about 60% at a point along conduit 28 corresponding with the position of axis 54, thereby permitting the heavier particles to fall from the air stream while the lighter aluminum alloy particles continue to travel substantially horizontally toward outlet 44. Additionally, because of the smooth, non-abrupt flow area transition from inlet 42 toward outlet conduit 62, the reduction in the velocity of the air stream carrying the particles is accomplished relatively smoothly, without the generation within conduit 28 of a large amount of turbulence, and thus the substantially laminar horizontal flow along conduit axis 40 of the aluminum particles is not disturbed, thereby resulting in the removal from the particle flow stream of fewer aluminum alloy particles that are desired to be recovered for recycling. A similar smooth, non-abrupt flow area transition from outlet conduit 62 toward outlet 44 of conduit 28 maintains low air turbulence within conduit 28, contributing to the recovery of most of the aluminum alloy particles.

Separation of the undesired, heavier particles from the lighter, aluminum alloy particles has been found to be more effective when the flow stream through conduit 28 is generated by attaching the suction side of the blower to outlet 44, rather than by blowing the particles into conduit 28 by a blower placed at inlet 42. Additionally, the efficiency of gravimetric separation of heavier materials is improved by having outlet conduit 62 completely open, to permit the heavier materials to fall from conduit 28 to be collected for disposal. In that regard, if outlet conduit 62 is closed, particles will accumulate and will ultimately rise to a level to cause both desired and undesired particles to flow through conduit 28. An outlet conduit that has a cross-sectional area of approximately ⅓ the cross-sectional area of conduit inlet 42 has been found to be suitable.

In operation, materials presented for recycling, whether crushed or uncrushed, are introduced into hopper 12 and are conveyed past magnetic separator 16 to enter tank scale 18 for weighing. After weighing the materials are conveyed to surge hopper 22 and then to shredder 26.

The shredded material is in particulate form, and the particles are drawn from shredder 26 through conduit 28, within which the undesirable, heavier particles of non-aluminum-alloy-material are separated from the lighter aluminum alloy particles and are separately collected. The aluminum alloy particles are blown into a shred trailer for reclamation and for recycling into new beverage cans and other articles.

Surprisingly, ferrous articles have been found in the materials collected at discharge opening 64. Removal of the ferrous articles is an unexpected benefit provided by the invention. Also, by measuring the amount of collected ferrous materials, the efficiency of magnetic separator 16 can be monitored.

Figure 4:
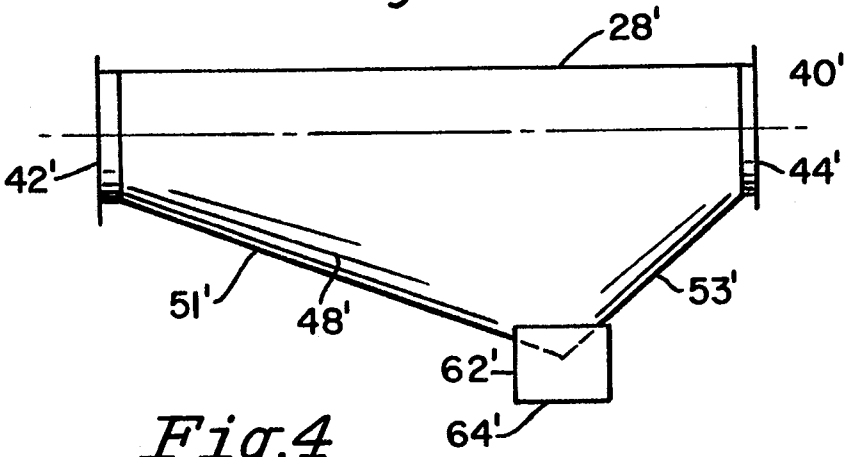
FIG. 4 is a schematic side elevational view of another embodiment of a separator device according to the present invention for separating heavier materials from shredded aluminum alloy UBC.

Referring now to FIG. 4, another representative embodiment of the invention is illustrated. Reference numerals, with primes attached, are used to identify components similar to those previously described. With this embodiment, conduit 28' has a longitudinal central axis 40' extending between inlet 42' and outlet 44'. Lower portion 48' of conduit 28' has a diverging portion 51' and a converging portion 53' that meet at conduit 62' having opening 64' that provides the dual function of introducing air into conduit 28' and providing an outlet for the removal of heavy particles removed by gravimetric separation from a stream of particles passing through the conduit 28'. In one embodiment, the distance "A" from axis 40' to the bottom of lower portion 48' is 14 inches, the length "B" of section 51' is approximately 29 inches, the length "C" of section 53' is approximately 12 inches, conduit 62' ("D") is 6 inches square, and the inlet 42' and outlet 44' have 8 inch diameter flanges. The inclination angle $\theta_2$ is approximately 40°, and the inclination angle $\theta_1$ is approximately 20°. The dimension "A" is important for successful operation. If the distance is too short, too much air can be drawn into the conduit. If the distance is too great, not enough air is drawn into the conduit so that the lower portion 48' becomes full of material. With this embodiment and using a 3500 cu. ft./min. blower, the particle stream of UBC flowing through the conduit decelerates from approximately 10,000 feet per minute to approximately 3800 feet per minute at the widest part of the conduit. At this rate, the force of gravity has sufficient time to act on the large particles so they fall out of the product stream into conduit 62'. The rate of increase in the size of section 51' is selected so that the particles have a sufficient time to accelerate before reaching the largest portion of the conduit. The length of section 53' is selected to avoid excessive contact and abrasion if the outlet angle is too steep.

With one embodiment of the invention used to remove lead from a UBC stream of particles, approximately 11 pounds of material was removed from 45,000 pounds of material being processed. It is believed that use of the invention has reduced the lead content of the UBC being processed by at least 50%. There could be a reduction of over 66%. In fact, even greater reductions in peak lead contents have been experienced in plant environments.

Although particular embodiments of the present invention have been illustrated and described, it will be apparent to those skilled in the art that various changes and modifications can be made without departing from the spirit of the present invention. Accordingly it is intended to encompass within the appended claims all such changes and modifications that fall within the scope of the present invention.

What is claimed is:

1. A particle separation conduit for receiving and conveying a stream of shredded aluminum particles and relatively heavier weight contaminant particles and for separating the relatively heavier weight contaminant particles contained within the stream from the lighter weight aluminum particles contained within the stream, said conduit comprising:

a) an inlet for receiving relatively heavier weight contaminant particles and relatively lighter weight aluminum particles carried by an air stream;

b) an outlet spaced from and coaxial with the inlet for receiving and conveying relatively lighter weight aluminum particles carried by the air stream after the relatively lighter weight particles pass through the conduit; and c) an intermediate section positioned between the inlet and the outlet, the intermediate section including a first, diverging portion having an enlarging cross-sectional area, and a second, converging portion having a diminishing cross-sectional area, and a particle outlet at a lower portion of the intermediate section at a region where the first and second portion join for permitting removal from the intermediate section of relatively heavier weight contaminant particles that settle out from a stream of particles that are drawn into the inlet in a direction toward the outlet, wherein the length of the second, converging portion of the intermediate section is shorter than that of the first, diverging portion.

2. A particle separation conduit in accordance with claim 1 wherein the inlet includes a constant cross-sectional area section that has a predetermined axial length.

3. A particle separation conduit in accordance with claim 1 wherein the first and second portions of the intermediate section have substantially planar sidewalls.

4. A particle separation conduit in accordance with claim 1 wherein the intermediate section defines a unitary separation zone within the conduit for gravimetrically separating heavier weight particles from lighter weight particles.

5. A particle separation conduit in accordance with claim 1 wherein the first and second portions of the intermediate section are defined by a common top wall and by linearly aligned side walls, and wherein the first and second portions each include sloping bottom walls that meet at the particle outlet.

6. A particle separation conduit in accordance with claim 5 wherein the inlet and the outlet are coaxial and wherein the slope of the bottom wall of the second portion defines an angle of from about 30° to about 60° relative to the inlet and outlet axes.

7. A particle separation conduit in accordance with claim 6 wherein the slope of the bottom wall of the first portion defines an angle of from about 6° to about 20° relative to the inlet and outlet axes.

8. A particle separation conduit in accordance with claim 7 wherein the conduit inlet and the conduit outlet have substantially the same cross-sectional area, and the particle outlet cross-sectional area is about $\frac{1}{3}$ the cross-sectional area of the conduit outlet.

9. A particle separation conduit in accordance with claim 1 wherein the axial length of the second, converging portion is less than about 38% of the sum of the axial lengths of the first and second portions of the intermediate section.

10. A particle separation conduit in accordance with claim 9 wherein the axial length of the second, converging portion is from about 5% to about 25% of the sum of the axial lengths of the first and second portions of the intermediate section.

11. A recycling plant for receiving material for recycling, wherein the material includes aluminum alloy beverage cans to be recovered for reprocessing, said plant comprising:

a) a shredder for reducing the size of the material presented for recycling;

b) a blower for conveying particles of shredded recyclable material from the shredder to a container for transport to a melting station; and c) a separation conduit positioned between the shredder and the blower for separating relatively heavier weight contaminant particles from lighter weight aluminum particles as particles pass through the separation conduit from the shredder to the blower, wherein the separation conduit includes an inlet communicating with the shredder and an outlet communicating with the blower, and an intermediate section positioned between the separation conduit inlet and the separation conduit outlet, the intermediate section including a first, diverging portion defined by a gradually enlarging cross-sectional area, and a second, converging portion defined by a gradually diminishing cross-sectional area, and a heavier weight particle outlet at a lower portion of the intermediate section in a region where the first and second sections join, said particle outlet being open to the ambient environment during operation for admitting air into the conduit, wherein the particle outlet permits continuous introduction of air into the conduit and removal from the intermediate section of relatively heavier weight particles that settle out from a stream of particles that are drawn into the separation conduit inlet in a direction toward the separation conduit outlet.

12. A recycling plant in accordance with claim 11 wherein the separation conduit inlet and the separation conduit outlet are coaxial and wherein the slope of the bottom wall of the second portion defines an angle of from about 30° to about 60° relative to the inlet and outlet axes.

13. A recycling plant in accordance with claim 12 wherein the slope of the bottom wall of the first portion defines an angle of from about 6° to about 30° relative to the inlet and outlet axes.

14. A recycling plant in accordance with claim 13 wherein the particle outlet cross-sectional area is about $\frac{1}{3}$ the cross-sectional area of the separation conduit outlet.

15. A recycling plant in accordance with claim 11 wherein the axial length of the second, converging portion is less than about 38% of the sum of the axial lengths of the first and second portions of the intermediate section.

16. A recycling plant in accordance with claim 15 wherein the axial length of the second, converging portion is from about 5% to about 20% of the sum of the axial lengths of the first and second portions of the intermediate section.

17. A recycling plant in accordance with claim 11, wherein the second, converging portion of the intermediate section is of a shorter length than that of the first, diverging portion.

18. A particle separation conduit for receiving and conveying a stream of particles and for separating relatively heavier weight particles contained within the stream from relatively lighter weight particles contained within the stream, said conduit comprising:

a) an inlet for receiving a mixed stream of relatively heavier weight and relatively lighter weight particles carried by an air stream;

b) an outlet spaced from the inlet for receiving and conveying relatively lighter weight particles carried by the air stream after passing through the conduit; and c) an intermediate section positioned between the inlet and the outlet, the intermediate section including a first, diverging portion defined by a gradually enlarging cross-sectional area, and a second, converging portion defined by a gradually diminishing cross-sectional area, and a particle outlet at a lower portion of the intermediate section in a region where the first and second sections join for permitting:

1) unimpeded discharge from the intermediate section of relatively heavier weight particles that settle out from a stream of particles moving from the inlet in a direction toward the outlet, and 2) flow of air into the intermediate section to prevent accumulation of relatively heavier weight particles within the conduit, wherein said inlet, said outlet, and said intermediate section define a smooth, non-abrupt flow area transition from aid inlet to said outlet thereby avoiding the generation within said intermediate section of a large amount of turbulence so that the relatively lighter weight particles have substantially laminar horizontal flow through said conduit.

19. A recycling plant in accordance with claim 11 wherein the separation conduit inlet and the separation conduit outlet have substantially the same cross-sectional area.

20. A particle separation conduit in accordance with claim 18 wherein said inlet and said outlet are coaxial.

* * * * *